US011019929B2

(12) United States Patent
Haertl et al.

(10) Patent No.: US 11,019,929 B2
(45) Date of Patent: Jun. 1, 2021

(54) COLLAPSIBLE CHAIR

(71) Applicant: ABIDA LLC, Camas, WA (US)

(72) Inventors: Roland A. Haertl, Camas, WA (US); David E. Gilman, Camas, WA (US); Chase T. Thompson, Lake Oswego, OR (US)

(73) Assignee: ABIDA LLC, Camas, WA (US)

( * ) Notice: Subject to any disclaimer, the term of this patent is extended or adjusted under 35 U.S.C. 154(b) by 0 days.

(21) Appl. No.: 16/414,691

(22) Filed: May 16, 2019

(65) Prior Publication Data

US 2020/0000233 A1 Jan. 2, 2020

Related U.S. Application Data

(60) Provisional application No. 62/672,526, filed on May 16, 2018.

(51) Int. Cl.

| | |
|---|---|
| ***A47C 7/24*** | (2006.01) |
| ***A47C 4/24*** | (2006.01) |
| ***A47C 4/02*** | (2006.01) |
| ***A47C 4/03*** | (2006.01) |
| *A47C 9/10* | (2006.01) |
| *A47C 7/02* | (2006.01) |
| *A47C 9/00* | (2006.01) |

(52) U.S. Cl.

CPC ..... *A47C 4/24* (2013.01); *A47C 4/027* (2013.01); *A47C 4/03* (2013.01); *A47C 7/027* (2013.01); *A47C 9/00* (2013.01); *A47C 9/10* (2013.01); *A47C 9/105* (2013.01)

(58) Field of Classification Search

CPC ..... A47C 4/04–26; A47C 9/00; A47C 9/10; A47C 9/105; A47C 7/027; A47C 7/03

See application file for complete search history.

(56) References Cited

U.S. PATENT DOCUMENTS

| | | | |
|---|---|---|---|
| 34,096 | A | 1/1862 | Wade |
| 151,585 | A | 6/1874 | Gray |

(Continued)

FOREIGN PATENT DOCUMENTS

| | | | |
|---|---|---|---|
| CN | 2115702 | U | 9/1992 |
| CN | 2167583 | Y | 6/1994 |

(Continued)

OTHER PUBLICATIONS

Everwhere Chair, LLC, http://everywherechair.com/stick-chair_html#.UrCf0p3Tm71, "The Original Stick Chair, Collapsible Folding Seat, and Walking Cane" accessed Dec. 6, 2013, 4 pgs.

(Continued)

*Primary Examiner* — Syed A Islam

(74) *Attorney, Agent, or Firm* — Kolisch Hartwell, P.C.

(57) ABSTRACT

A chair operable between an extended configuration and a collapsed configuration includes one or more legs, a handle and a locking mechanism. The one or more legs support a seat and the handle extends away from the seat opposite the one or more legs. The locking mechanism includes a lock plug disposed in an elongate trough. Movement of the handle between the extended and collapsed configurations involves depressing the lock plug and flipping the trough to an opposite side of the lock plug.

1 Claim, 13 Drawing Sheets

(56) References Cited

U.S. PATENT DOCUMENTS

| | | | | |
|---|---|---|---|---|
| 159,898 | A | 2/1875 | Byram | |
| 295,216 | A | 3/1884 | Wright | |
| 517,351 | A | 3/1894 | Mathewson | |
| 542,609 | A | 7/1895 | Gordon et al. | |
| 574,011 | A | 12/1896 | Springsted | |
| 617,661 | A | 1/1899 | Smith | |
| 767,246 | A | 8/1904 | Rogers | |
| 954,473 | A | 4/1910 | Schocke | |
| 1,089,295 | A | 3/1914 | Vallier | |
| 1,972,668 | A | 9/1934 | Sheldon | |
| 2,002,118 | A | 5/1935 | Johnson | |
| 2,127,976 | A | 8/1938 | K-Howat | |
| 2,133,047 | A | 10/1938 | Sheldon | |
| 2,380,437 | A | 7/1945 | Homrighausen | |
| 2,542,040 | A | 2/1951 | MacLellan | |
| 2,578,989 | A | 12/1951 | Wirsig | |
| 2,587,543 | A | 2/1952 | Smith | |
| 2,629,429 | A | 2/1953 | Baumfeld et al. | |
| 2,649,140 | A * | 8/1953 | Housel | A45B 5/00 248/431 |
| 2,771,938 | A | 11/1956 | Neblich | |
| 2,798,536 | A * | 7/1957 | Shew | A47C 9/105 248/155.2 |
| 3,038,690 | A | 6/1962 | Alexiou | |
| 3,084,896 | A * | 4/1963 | Alexiou | A47C 9/105 108/118 |
| 3,266,839 | A * | 8/1966 | Combs | A47C 9/105 297/57 |
| 3,310,340 | A | 3/1967 | Brewer et al. | |
| 3,544,051 | A | 12/1970 | Norman et al. | |
| 3,815,952 | A | 6/1974 | Minsker | |
| 4,317,519 | A | 3/1982 | Talley | |
| 4,603,902 | A * | 8/1986 | Maloney | A47D 1/0081 297/35 |
| 4,685,732 | A | 8/1987 | Kapp et al. | |
| 4,705,250 | A | 11/1987 | Eastman | |
| 4,934,638 | A * | 6/1990 | Davis | A47C 4/286 108/118 |
| D338,345 | S | 8/1993 | Camp | |
| 5,375,906 | A * | 12/1994 | Snyder | A47C 4/20 297/39 |
| 5,411,313 | A | 5/1995 | Counihan et al. | |
| 5,433,234 | A | 7/1995 | Lapere | |
| 5,478,138 | A | 12/1995 | Yu | |
| 5,503,460 | A | 4/1996 | Yu | |
| D396,569 | S | 8/1998 | Chen | |
| 6,192,908 | B1 | 2/2001 | Smith | |
| 6,467,843 | B1 * | 10/2002 | Rossborough | A47C 3/34 108/150 |
| 6,478,375 | B2 | 11/2002 | Richardson | |
| 6,536,079 | B2 * | 3/2003 | Hill | A47C 4/20 108/168 |
| 6,651,684 | B2 | 11/2003 | Spitzer | |
| 6,899,388 | B1 * | 5/2005 | Enrique | A47C 7/66 297/129 |
| 7,219,679 | B2 | 5/2007 | Hsu et al. | |
| 7,316,449 | B2 | 1/2008 | Lynch et al. | |
| 8,876,203 | B1 * | 11/2014 | Haertl | A47C 4/04 297/118 |
| 8,997,766 | B2 | 4/2015 | Pao | |
| 9,144,312 | B2 | 9/2015 | Grace | |
| 9,179,746 | B2 | 11/2015 | Gullo | |
| 9,357,820 | B2 | 6/2016 | Pao | |
| 10,064,462 | B2 * | 9/2018 | Pao | A47C 13/00 |
| 10,681,985 | B2 * | 6/2020 | Lin | A47C 4/04 |
| 2007/0216212 | A1 | 9/2007 | Micheel | |
| 2012/0139310 | A1 | 6/2012 | Aldred | |
| 2013/0074743 | A1 | 3/2013 | Li | |
| 2014/0034097 | A1 | 2/2014 | Pao | |
| 2014/0034098 | A1 | 2/2014 | Pao | |
| 2014/0060598 | A1 | 3/2014 | Pao | |
| 2015/0075576 | A1 | 3/2015 | Gullo | |
| 2015/0327636 | A1 | 11/2015 | Pao | |
| 2016/0367031 | A1 | 12/2016 | Haertl et al. | |
| 2017/0119159 | A1 | 5/2017 | Mailloux | |
| 2018/0146786 | A1 | 5/2018 | Haertl et al. | |

FOREIGN PATENT DOCUMENTS

| | | | |
|---|---|---|---|
| CN | 1095252 | A | 11/1994 |
| CN | 2200951 | Y | 6/1995 |
| CN | 2279092 | Y | 4/1998 |
| CN | 2332225 | Y | 8/1999 |
| CN | 2420887 | Y | 2/2001 |
| CN | 2462719 | Y | 12/2001 |
| CN | 1596793 | A | 3/2005 |
| CN | 201001527 | Y | 1/2008 |
| CN | 201328443 | Y | 10/2009 |
| CN | 201630380 | U | 11/2010 |
| CN | 202014869 | U | 10/2011 |
| CN | 202236165 | U | 5/2012 |
| CN | 202396623 | U | 8/2012 |
| CN | 202445280 | U | 9/2012 |
| DE | 3642622 | A1 | 6/1988 |
| EP | 2292121 | A1 | 3/2011 |
| FR | 2590781 | A1 | 6/1987 |
| GB | 125269 | | 4/1919 |
| GB | 269715 | | 4/1927 |
| GB | 391666 | | 5/1933 |
| JP | 06066338 | U | 9/1994 |
| JP | 07009120 | U | 2/1995 |
| JP | 09075172 | | 3/1997 |
| JP | 2007209590 | | 8/2007 |
| JP | 2009056209 | A | 3/2009 |
| JP | 2015080724 | A | 4/2015 |
| JP | 2015131109 | A | 7/2015 |
| JP | 2017060769 | A | 3/2017 |
| WO | 2004021838 | A1 | 3/2004 |
| WO | 2014019218 | A1 | 2/2014 |
| WO | 2014040285 | A1 | 3/2014 |
| WO | 2014078975 | A1 | 5/2014 |
| WO | 2016081840 | A1 | 5/2016 |

OTHER PUBLICATIONS

Hornung's Golf Products, Inc., http://www.ebay.com/bhp/golf-folding-chair, "Golf Spectator Seat Stick Outdoor Adjustable Folding Walking Cane and Chair", accessed Dec. 6, 2013, 8 pgs.

MacSports Inc., http://universaldesignproducts.com/store/B006JPYV, "Folding Cane Chair—Walking Stick with Tripod Stool", accessed Dec. 6, 2013, 3 pgs.

RAM Mount Vertical Bent Swing Arm with Rectangular Post Plate, www.gpscity.com/ram-mount-vertical-bent-swing-arm-with-rectangular-post-plate.html, Copyright © 1996-2013 GPS City ®, accessed Oct. 30, 2013, 3 pgs.

Shijiazhuang Aofeite Import & Export Co., Ltd, http://www.alibaba.com/product-gs/597843406/3_legged_chair_stick_folding_chair.html, "3-legged chair stick, folding chair stick", accessed Feb. 5, 2014, 6 pgs.

Surgical Medical Source, http://www.amazon.com/Tri-Seat-Adjustable-Seat-Cane-Color/dp/B000C4RRWS/ref=pd_sim_sg_1, "Tri-Seat Adjustable Seat Cane", accessed Feb. 5, 2014, 5 pgs.

* cited by examiner

COLLAPSIBLE CHAIR

CROSS-REFERENCE TO RELATED APPLICATIONS

The present application claims the benefit under 35 U.S.C. § 119(e) of U.S. Provisional Patent Application Ser. No. 62/672,526, filed May 16, 2018 and entitled COLLAPSIBLE CHAIR, which is hereby incorporated by reference in its entirety for all purposes.

TECHNICAL FIELD

The disclosure relates to chairs. More particularly, the disclosure relates to collapsible chairs.

INTRODUCTION

Generally, collapsible chairs are used for seating in areas where permanent seating is not possible or practical. This includes outdoor and indoor events such as funerals, college graduations, religious services, sporting events and competitions, and the like. In addition, collapsible chairs may be used for any situation that may require extra seating.

Collapsible chairs exist which are operable between an extended configuration that provides a seating surface, and a collapsed configuration in which the chair may be transported. However, Applicant has found that these pre-existing collapsible chairs are not particularly suitable for travelers, particularly travelers with decreased mobility. For example, pre-existing chairs typically either have a collapsed configuration that is too large to carry onto a commercial airliner, or an extended configuration that does not provide adequate support for a user that has difficulty standing up and sitting down. Also, operating pre-existing collapsible chairs between extended and collapsed configurations (and/or securing these chairs in these configurations) typically involves manipulation of relatively complicated or inconvenient mechanisms.

BRIEF SUMMARY

One or more embodiments of a chair disclosed herein may overcome one or more of the above identified deficiencies of pre-existing collapsible chairs.

In a first example, a chair operable between an extended configuration and a collapsed configuration is provided. The chair may include one or more legs and a handle. The one or more legs may support a seat and the handle may extend away from the seat opposite the one or more legs. The chair may include a locking mechanism having a lock plug disposed in an elongate trough. Movement of the handle between the extended and collapsed configurations may involve depressing the lock plug and flipping the trough to an opposite side of the lock plug.

In a second example, a chair operable between an extended configuration and a collapsed configuration may include one or more legs and a handle. The one or more legs may support a seat, and the handle may extend away from the seat opposite the one or more legs. The handle and the seat may be pivotally connected to at least one of the legs about a combined pivot axis.

In a third example, a chair operable between an extended configuration and a collapsed configuration may include one or more legs, a handle, and a joint. The one or more legs may support a seat and the handle may extend away from the seat opposite the one or more legs. The joint may pivotally connect the handle to at least one of the legs about a handle pivot axis. The joint may include a locking mechanism for selectively securing the handle in the extended and collapsed configurations.

Figure 1:
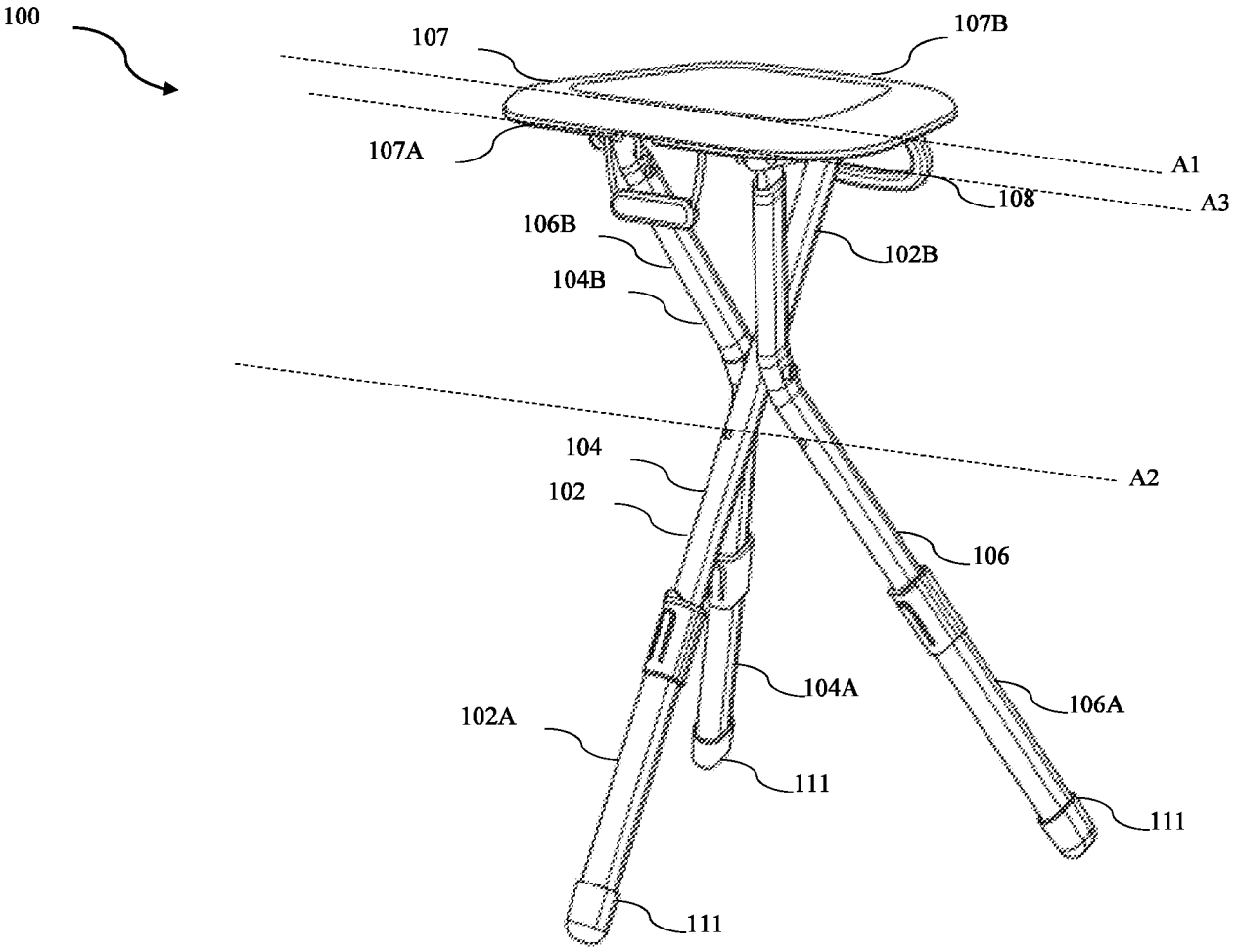
FIG. 1 is a perspective view of a chair in an extended configuration, with the chair including a first leg, a second leg, a third leg, a seat, and a joint connecting a handle to the first leg, according to the present disclosure.

Appendix A includes other drawings that illustrate other features of the inventions.

Those with ordinary skill in the art will appreciate that the elements in the drawings are illustrated for simplicity and clarity and are not necessarily drawn to scale. For example, the dimensions of some of the elements in the drawings may be exaggerated, relative to other elements, in order to improve the understanding of the disclosure.

There may be additional structures described in the description that are not depicted in the drawings, and the absence of such a drawing should not be considered as an omission of such design from the specification.

DETAILED DESCRIPTION

FIG. 1 shows a perspective view of a chair 100, according to the present disclosure. As shown, chair 100 may include one or more legs, such as a first leg 102, a second leg 104, and a third leg 106, a seat 107, and a handle 108. As shown, handle 108 may extend away from bottom part of the seat 107 in similar direction of legs 102, 104, and 106.

The one or more legs may support seat 107. For example, respective lower portions 102*a*, 104*a*, and 106*a* of legs 102, 104, and 106 may include respective feet 111 that may be positioned on the ground to substantially stabilize seat 107 against vertical and lateral forces.

First leg 102 may be a rear leg of chair 100, and second and third legs 104 and 106 may be a pair of front legs of chair 100. For example, a user may sit on seat 107, with handle 108 extending outward ward underneath the seat 107. Second and third legs 104 and 106 of chair 100 may press against the ground proximate the legs of the user, and first leg 102 may press against the ground under and/or behind the user's posterior. In this position, the user may easily grasp handle 108, shown here as resembling a closed loop handle, for increased stability. In this extended configuration, seat 107 may be generally parallel to the ground and may define a sitting surface for the user to sit thereon comfortably.

Figure 6:
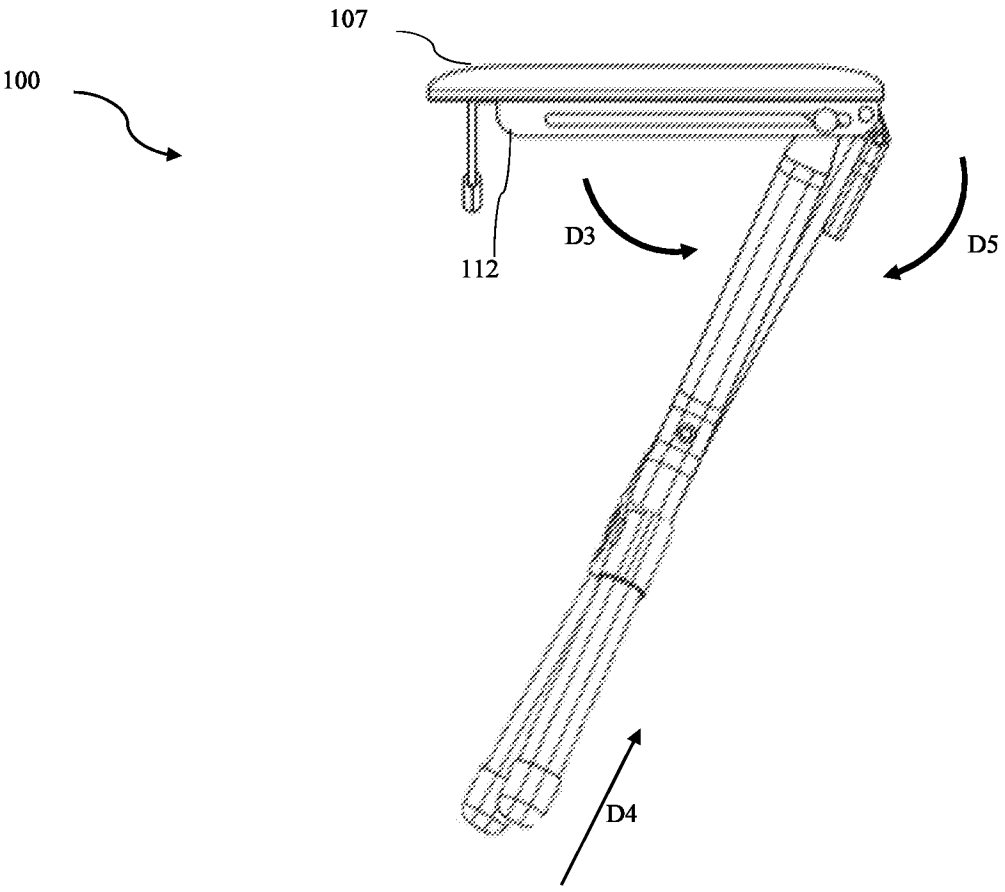
FIG. 6 is a side view of the chair of FIG. 1 showing a direction of handle movement while transitioning the legs to a collapsed configuration from the extended configuration.

Chair 100 may be operable between an extended configuration (shown in FIG. 1) and a collapsed configuration (shown in FIG. 6). In the extended configuration, chair 100 may be dimensioned to provide both stability and convenience, particularly for users with decreased mobility. For example, in the extended configuration, seat 107 may be supported at a height above the ground that is similar to that of a conventional chair, such as at a height of about 18 to 24 inches, and handle 108 may extend outward from under the seat 107 for the user to hold handle 108 and easily sit down on and stand up from seat 107 without excessive bending.

In the collapsed configuration (see FIG. 6), chair 100 may have overall dimensions that allow chair 100 to be easily carried and/or stowed (e.g., for convenient travel). For example, chair 100 in the collapsed position may have an overall length that is less than or equal to a predetermined longest allowable exterior dimension of a carry-on airline luggage piece (which in the United States is currently 19.5 inches), so that the user may stow chair 100 in the collapsed position in an overhead compartment of a commercial airliner.

Applicant has found that incorporating one or more of the following features into a chair, according to aspects of the present disclosure, may provide for both increased stability and convenience of the chair in the extended and/or collapsed configurations (and/or movement there between).

Figure 2A:
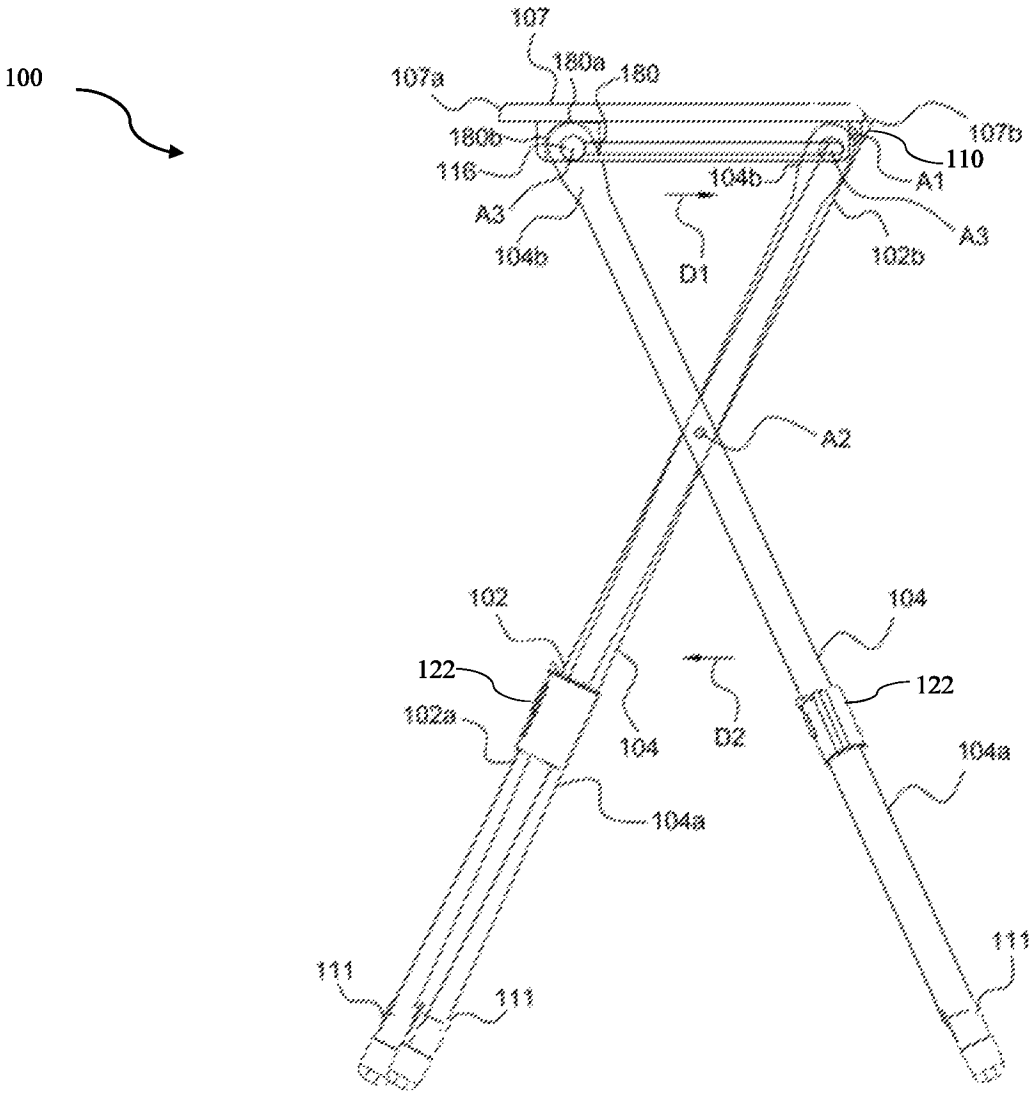
FIG. 2A is a side view of the chair of FIG. 1 showing a direction of leg movement while transitioning the legs to a collapsed configuration from the extended configuration.

For example, chair 100 may include a joint 110 (shown in FIG. 2A). The joint 110 may pivotally connect handle 108 (not shown in FIG. 2 for purpose of clarity) to at least one of the one or more legs. The joint 110 pivotally connects handle 108 to first leg 102. First leg 102 may include an upper portion 102*b* connected to lower portion 102*a* by a central portion 102*c*, and the joint 110 may pivotally connect handle 108 to upper portion 102*b*. Pivoting of handle 108 about axis A1 may involve handle 108 moving or pivoting toward lower portions 102*a*, 104*a*, and 106*a* of respective legs 102, 104, and 106 about axis A1.

The one or more legs may be pivotally connected to one another about a leg pivot axis A2. Second leg 104 may include an upper portion 104*b* connected to lower portion 104*a* by a central portion 104*c*. Third leg 106 may include an upper portion 106*b* connected to lower portion 106*a* by a central portion 106*c*. Central portion 102*c* of first leg 102 may be pivotally connected to central portions 104*c* and 106*c* of respective legs 104 and 106.

Seat 107 may include first and second seat slots 112 and 114. Upper portion 104*b* of leg 104 may include a pin 116 slidingly engaged in slot 112, and upper portion 106*b* of leg 106 may include a pin 118 slidingly engaged in slot 114. Pins 116 and 118 may define a sliding axis A3. As shown, axes A3, A2, and A1 may be parallel to one another.

Upper portions 104*b* and 106*b* of legs 104 and 106 may pivot toward upper portion 102*b* of leg 102 about axis A2, as lower portions 104*a* and 106*a* of legs 104 and 106 pivot toward lower portion 102*a* of leg 102 about axis A2, which may also involve axis A3 (and associated upper portions 104*b* and 106*b*) sliding in respective seat slots 112 and 114 toward joint 110.

Seat 107 may also be pivotally connected to leg 102 about axis A1, thus axis A1 may be described as a combined pivot axis for both handle 108 and seat 107. In other embodiments, seat 107 and handle 108 may be pivotally connected to leg 102 about different pivot axes.

Seat 107 may pivot about axis A1 towards axis A2 (see FIG. 1), as axis A3 slides toward joint 110 (or associated upper portion 102*b* of leg 102) from distal ends 112*a* and 114*a* to central portions 112*b* and 114*b* of respective seat slots 112 and 114 (see FIG. 2A).

Seat 107 may pivot about axis A1 toward axis A2 (see FIG. 2A), as axis A3 slides toward upper portion 102*b* from central portions 112*b* and 114*b* to proximal portions 112*c* and 114*c* of respective seat slots 112 and 114 (see FIG. 2A).

Each of lower portions 102*a*, 104*a*, and 106*a* of legs 102, 104 and 106 may include a push button mechanism 122. Mechanism 122 may be configured to allow for the lower portions 102*a*, 104*a*, and 106*a* of the legs 102, 104 and 106 to be selectively telescoped in (e.g., toward axis A2) and to be selectively telescoped out (e.g., away from axis A2).

Figure 7:
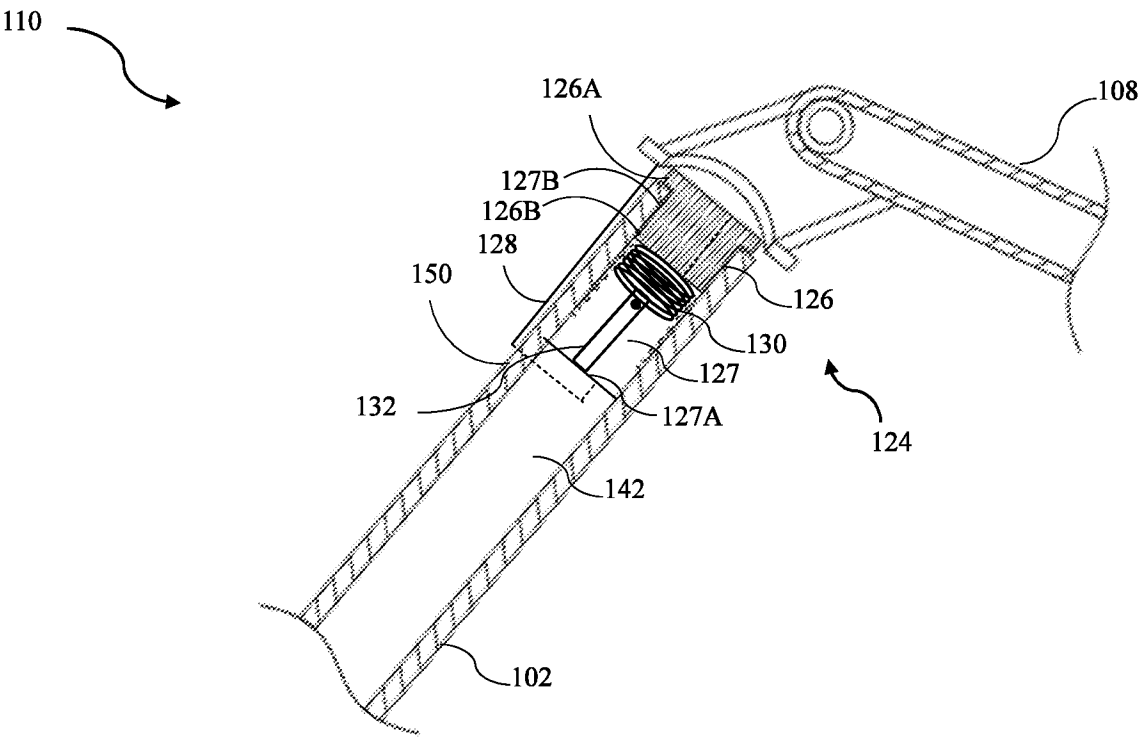
FIG. 7 is a semi-schematic cross-sectional view of the joint of FIG. 1 showing an embodiment of a lock plug in the OUT position to extend into and frictionally engage the first end portion of a trough to secure the handle in the extended configuration.

As can be seen in FIG. 7, joint 110 may include a locking mechanism 124 including a lock plug 126 having a first and second ends 126*a* and 126*b*, a trough 128, and a spring 130. Plug 126 may be disposed in trough 128, and spring 130 may press against plug 126. Trough 128 may be fixedly attached to (or included in) handle 108. Trough 128 may be pivotally connected to leg 102 about axis A1. Locking mechanism 124 may be configured to selectively secure handle 108 in the extended configuration and in the collapsed configuration, which is described in more detail below in relation to FIGS. 7-9.

Plug 126 may have a pair of slots 127 extending substantially parallel to an elongate direction of plug 126. The pair of slots 127 may be on opposite sides of plug 126. Spring 130 may be disposed in a hollow recess of plug 126 (see FIGS. 7, 8, and 9). Plug 126 may be disposed in bore 142. Pin 132 may extend through and be slidingly engaged in slot(s) 127. Pin 132 may retain spring 130 inside the hollow recess of plug 126 between pin 132 and a distal end (or cap portion) of plug 126 (see FIGS. 7, 8, and 9).

Trough 128 may wrap around and/or frictionally engage upper portion 102*b* of leg 102. Pin 132 may provide a surface upon which spring 130 may press to bias lock plug 126 to an OUT position, as will be described below in more detail. Trough 128 may wrap around and/or frictionally engage upper portion 102*b* of leg 102.

Second leg 104 and third leg 106 may be cylindrical pipes bent at their respective central portions, and may have equal lengths.

Figure 3:
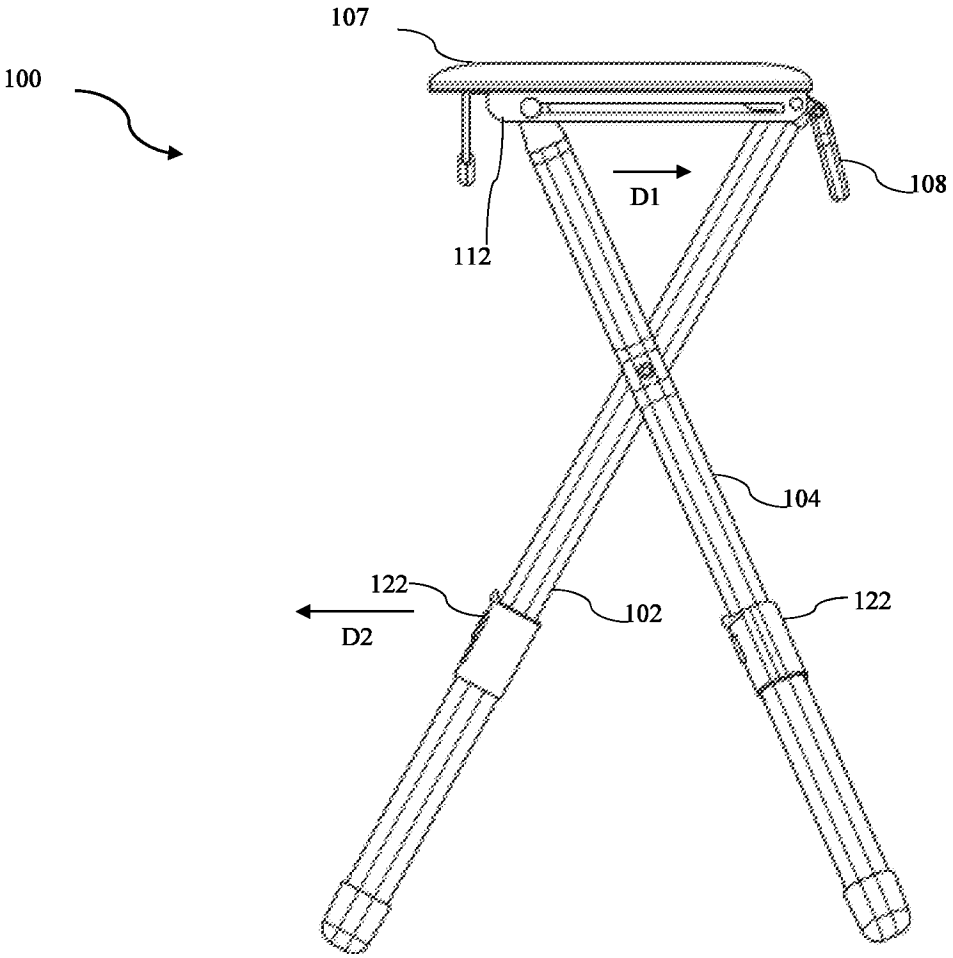
FIG. 3 is a side view of the chair of FIG. 1 showing a direction of leg movement while transitioning the legs to a collapsed configuration from the extended configuration.

As shown in FIG. 1, seat 107 may include a rear portion 107*a* and a front portion 107*b*. As shown in FIG. 3, slots 112 and 114 may extend from rear portion 107*a* toward front portion 107*b*. Front portion 107*b* of seat 107 may be pivotally connected to upper portion 102*b* of first leg 102, as described above. Upper portion 104*b* of second leg 104 and upper portion 106*b* of third leg 106 may include respective pins 116 and 118 that may be slidingly engaged in slots 112 and 114, as previously described. Pins 116 and 118 may extend through apertures in the respective upper portions 104*b* and 106*b* of legs 104 and 106.

Figure 4:
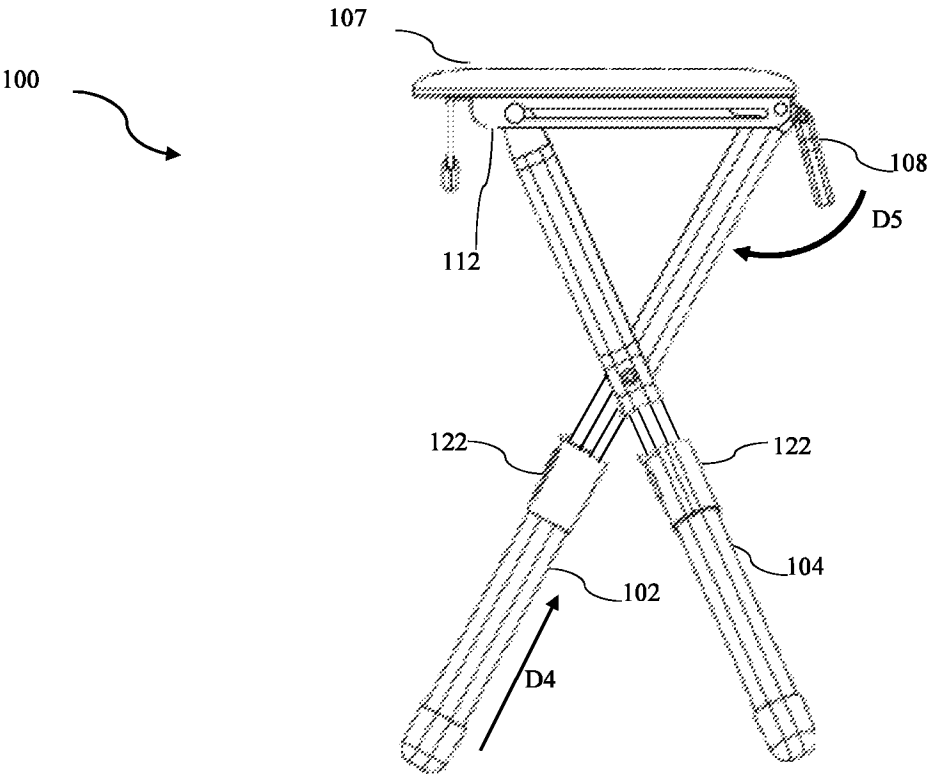
FIG. 4 is a side view of the chair of FIG. 1 showing a collapsed configuration from the extended configuration.

In an embodiment, leg 104 may move from the extended configuration to the collapsed configuration (shown in FIG. 4). For example, upper portion 104*b* of leg 104 may pivot about axis A2 toward upper portion 102*b* of leg 102 in a direction D1, and lower portion 104*a* of leg 104 may pivot about axis A2 toward lower portion 102*a* of leg 102 in a direction D2 to position legs 104 and 102 in a substantially flat configuration. Leg 106 may move in a similar fashion as leg 104, as shown in FIG. 4. However, leg 106 would be directly behind leg 104 in FIG. 3, thus leg 106 is not shown in FIG. 3.

As shown in FIGS. 3A-3C, a pocket (or a pocket formed by a wall) 180 and a pocket (or a pocket formed by a wall) 182 may extend from the bottom of seat 107 and may be proximate and parallel to respective first portion 112*a* of slot 112 and first portion 114*a* of slot 114. In the extended configuration of legs 104 and 106, wall portions of pockets 180 and 182 may bear against surfaces of respective upper portions 104*b* and 106*b* of legs 104 and 106 to reduce or prevent any downward and/or rearward load from being exerted on pins 116 and 118 in respective slots 112 and 114, which may improve the strength of chair 100.

For example, when the user sits on seat 107, a rearward load (in a direction away from front portion 107*b* and toward rear end portion 107*a*) and a downward load may be exerted on cantilevered upper portions 104*b* and 106*b*. If these loads were applied to pins 116 and 118, then these pins may bend, or in some cases may break (e.g., if the user is relatively large). However, by providing wall portions against which top and rear surfaces of upper portions 104*b* and 106*b* may press in the extended configuration, any load on pins 116 and 118 may be eliminated (or greatly reduced).

Figure 2B:
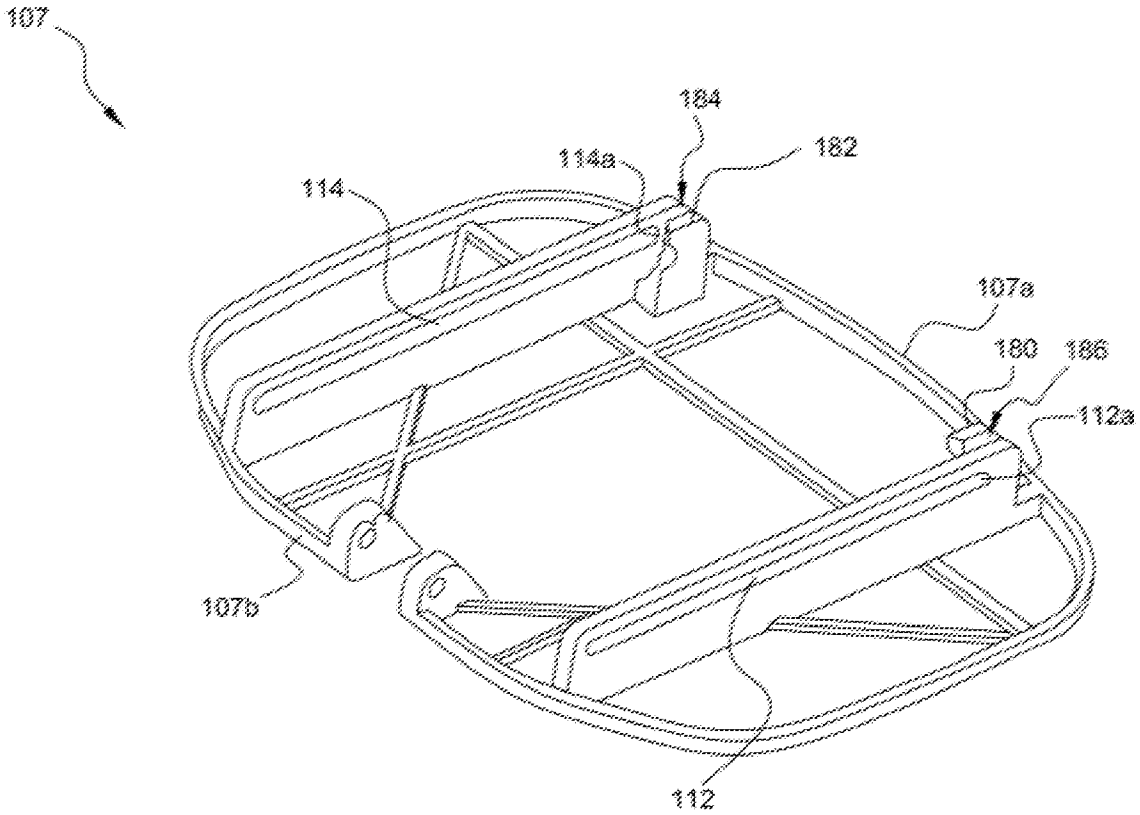
FIG. 2B is a perspective view of a bottom side of the seat of the chair of FIG. 1 showing pockets to support upper portions of the second and third legs in the extended configuration.
Figure 2C:
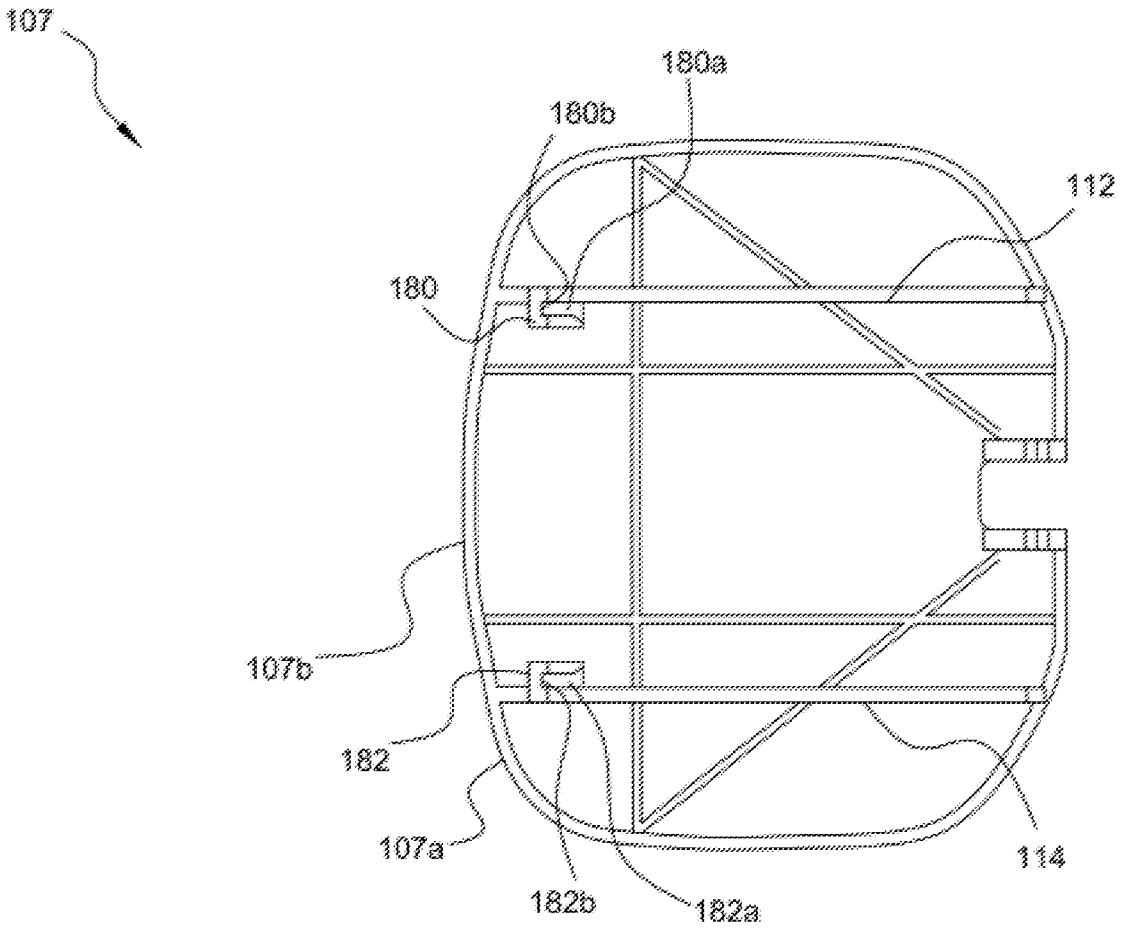
FIG. 2C is a cross-sectional view of the seat of FIG. 3B taken in a plane that extends through the seat slots to show upper and rear wall portions of the pockets for supporting respective rear and top surfaces of the second and third legs.

For example, as shown in FIG. 2A-2C, an upper wall portion 182*a* of pocket 182 may press against a top surface of upper portion 106*b* of leg 106 distal pin 118 in the extended configuration of leg 106, and a rear wall portion 182*b* of pocket 182 may press against a rear surface of upper portion 106*b* of leg 106 distal pin 118 in the extended configuration of leg 106.

As shown in FIG. 2A, an upper wall portion 180*a* of pocket 180 may press against a top surface of upper portion 104*b* of leg 104 distal pin 116 in the extended configuration of leg 104, and a rear wall portion 180*b* of pocket 180 may press against a rear surface of upper portion 104*b* of leg 104 distal pin 116 in the extended configuration of leg 104.

As shown in FIG. 2A, the wall portions of pockets 180 and 182 may be curved wall portions that may be shaped to correspond to (or closely match) a curvature of respective top and rear surfaces of upper portions 104*b* and 106*b*.

In some embodiments, pocket 180 may wrap upper portion 104*b* of leg 104, and pocket 182 may wrap upper portion 106*b* of leg 106. The rear (or back) surface of upper portion 104*b* of leg 104 may bear against a back wall portion 108*b* of pocket 180, and the rear (or back) surface of upper portion 106*b* of leg 106 may bear against back wall portion 182*b* of pocket 182. The top surface of upper portion 104*b* of leg 104 may bear against upper wall portion 180*a*, and the top surface of upper portion 106*b* of leg 106 may bear against upper wall portion 182*a* of pocket 182. In some embodiments, the upper wall portions of pockets 180 and 182 may be bottom surfaces of seat 107.

FIG. 2B is a bottom perspective view of seat 107 showing walls 180 and 182, which may form the pockets. For example, wall 180 may define a recess 184 in which upper portion 104*b* (see FIG. 2A) may be disposed in the extended configuration, and wall 182 may define a recess 186 in which upper portion 106*b* (see FIG. 1) may be disposed in the extended configuration. FIG. 2C is a cross-sectional view of seat 107 taken in a plane parallel to the view of FIG. 2B that passes through slots 112 and 114. As shown, walls (or pockets) 180 and 182 are both generally "c" shaped.

FIG. 3 shows the extended configuration of legs 104 and 106 in solid lines, and the collapsed configuration of legs 104 and 106 in dash double dot lines. As can be seen in FIG. 3, pins 116 and 118 may slide in direction D1 in respective slots 112 and 114 as upper portions 104*b* and 106*b* of second leg and third legs 106 move toward front portion 107*b* of seat 107, and as lower portions 104*a* and 106*a* pivot about axis A2 toward lower portion 102*a* of first leg 102 in direction D2.

Figure 5:
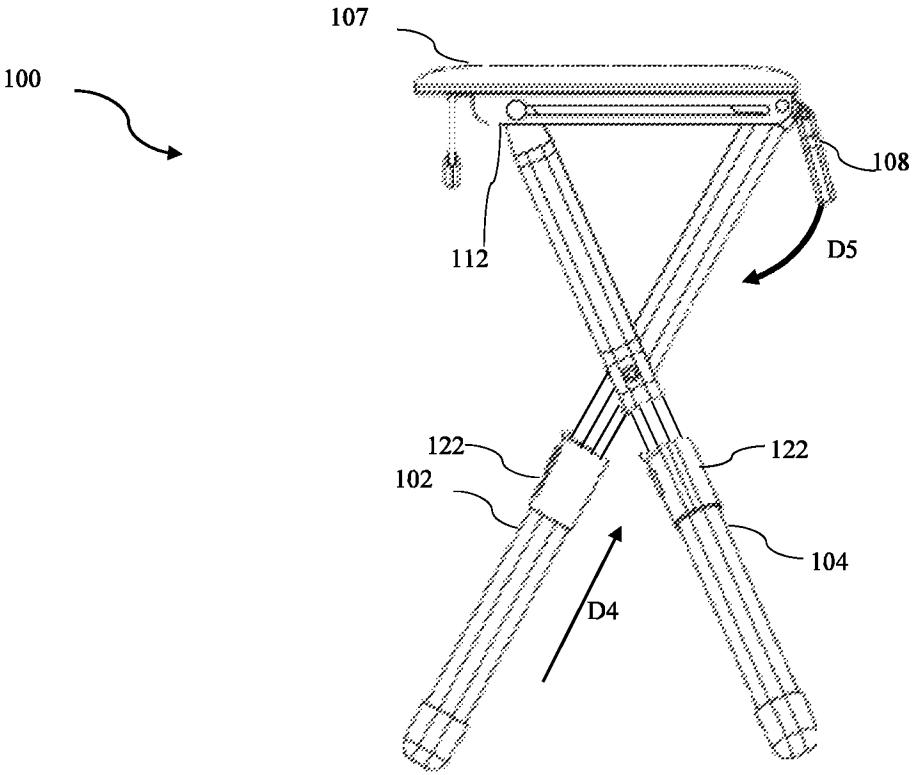
FIG. 5 is a side view of the chair of FIG. 1 showing a direction of handle movement while transitioning the legs to a collapsed configuration from the extended configuration.

FIG. 6 is a side view of chair 100 depicting movement of the seat 107. Movement of seat 107 from the extended configuration to the collapsed configuration may involve pivoting seat 107 about axis A1 in a direction D3. Pivoting seat 107 about axis A1 in direction D3 may result in pivoting axis A3 and associated second leg 104 and third leg 106 (leg 106 is not shown in FIG. 6 because leg 106 would be directly behind leg 104) about axis A2 to align leg 104 (and leg 106) with leg 102. Leg 104, before pivoting about axis A2 is shown in FIG. 5 in solid lines. Leg 104 after pivoting about axis A2 (and aligned with leg 102) is shown in dash double dot lines.

The lower portions of legs 102 and 104 (and leg 106) may be telescoped in toward trough 128 in a direction D4. A telescoped out position of legs 102 and 104 is shown in FIG. 3.

In FIG. 3, handle 108 is shown in the extended configuration in solid lines and FIGS. 4-5 show movement of the handle inwards, that is towards the base of the seat 107. Handle 108 may be adapted to pivot toward leg pivot axis A2 (in direction D5) about handle pivot axis A1 to position first leg 102, second leg 104, third leg 106 (not shown here), and handle 108 in a substantially flat configuration.

As described above, seat 107 may be adapted to pivot toward leg pivot axis A2 in direction D4, which may position upper portions 102*b*, 104*b* and 106*b* of first, second, and third legs 102, 104 and 106 between seat 107 and handle 108, as shown in FIG. 5. Leg 104 may slightly rotate about leg pivot axis A2 in a direction opposite to direction D3 when seat 107 moves in direction D3 to the collapsed configuration. Leg 104 and leg 102 (as well as leg 106, which is not shown here) may be aligned when seat 107 reaches the collapsed configuration (shown in double dot dash lines).

It may not be noted that third leg 106 may also move simultaneously with second leg 104 in a direction opposite to direction D3 when seat 107 moves in direction D3. Third leg 106 may be aligned with second leg 104 and first leg 102 when seat 107 is in the collapsed configuration.

As shown in FIG. 6, handle 108 in the collapsed configuration may press against (or be positioned proximal) leg 104 (and/or leg 106) that is substantially aligned with leg 102. Handle 108 pressing against (or securely positioned proximal to) leg 104 (and/or leg 106) may prevent pivoting the upper portions of legs 104 and 106 relative to the upper portion of leg 102, and thereby may prevent seat 107 from moving to the extended configuration. For example, sliding axis A3 is shown as offset from seat pivot axis A1 when legs 102 and 104 are in the collapsed configuration and substantially aligned, which may result in pivoting leg 104 about axis A2 in the direction D3 as seat 107 is pivoted about axis A1 in a direction opposite to direction D3. However, such pivoting seat 107 about axis A1 in a direction opposite to D3 may be arrested (or prevented) by handle 108 pressing against (or securely positioned proximal to) leg 104 to arrest (or prevent) pivoting leg 104 about axis A2 in direction D3.

In some embodiments, any one of apertures 120 (see FIGS. 1 and 2) on each of lower portions 102*a*, 104*a*, and 106*a* of legs 102, 104 and 106 may allow lower portions 102*a*, 104*a*, and 106*a* of legs 102, 104 and 106 to be telescoped in by push button mechanism 122. Mechanism 122 may selectively engage any one of apertures 120 on each of lower portions 102*a*, 104*a*, and 106*a* of legs 102, 104 and 106 respectively. Telescoping in of first leg 102, second leg 104, and third leg 106 and moving handle 108 in direction D5 (in FIG. 5) may reduce the length of chair 100. In the collapsed position, chair 100 may have an overall length L1 that may be less than or equal to a predetermined longest allowable exterior dimension of a carry-on airline luggage piece (e.g., 19.5 inches), so that the user may stow chair 100 in the collapsed configuration in an overhead compartment of a commercial airliner.

Figure 8:
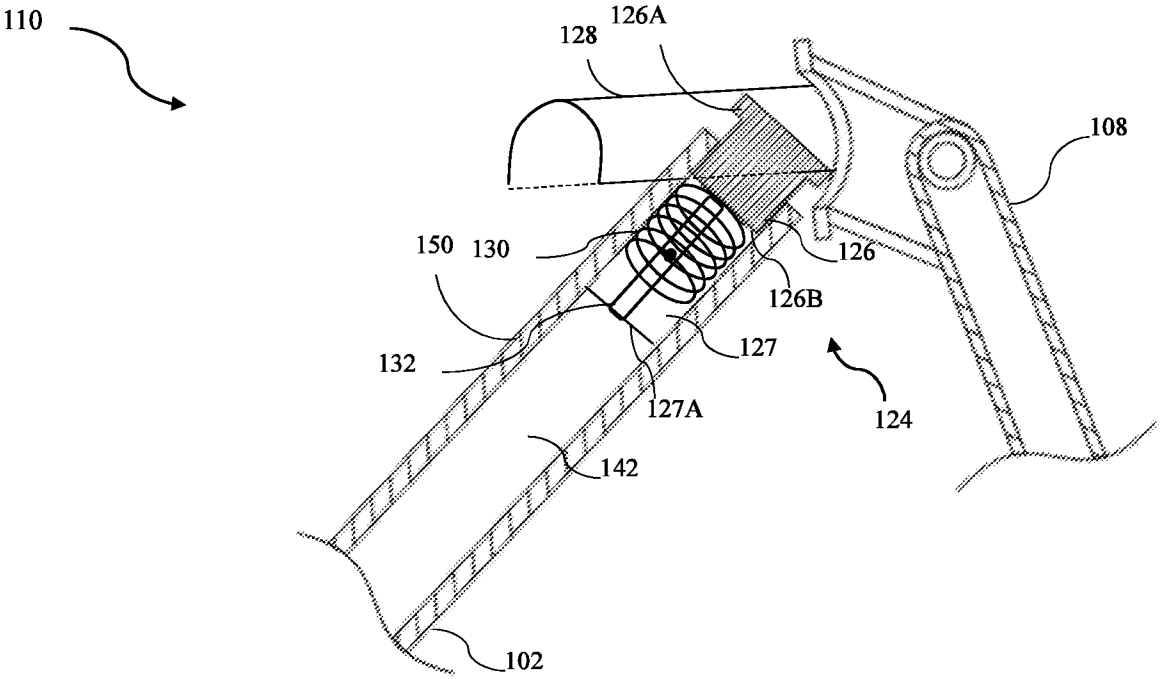
FIG. 8 is a semi-schematic cross-sectional view of the joint showing the lock plug of FIG. 7 depressed to the IN position and the handle pivoted toward the first leg about the handle pivot axis.
Figure 9:
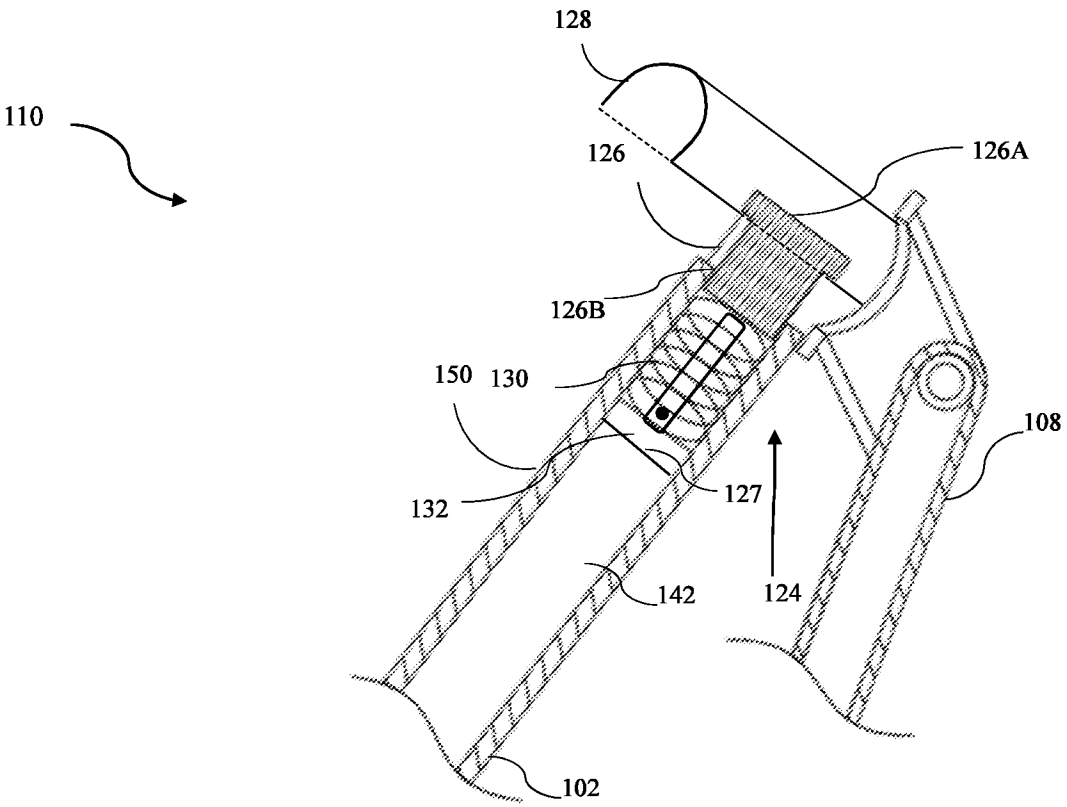
FIG. 9 is a semi-schematic cross-sectional view of the joint showing the handle further pivoted about the handle pivot axis, and the lock plug of FIG. 8 further depressed into the bore of the first leg.

Now referring to FIGS. 7-9, joint 110 may enable the transition of handle 108 from the extended configuration to the collapsed configuration (and vice versa), and locking mechanism 124 of joint 110 may selectively secure handle 108 in the extended configuration (see FIG. 1) and the collapsed configurations (see FIG. 6).

FIG. 7 is a cross-sectional view taken in a plane parallel to the view of FIG. 5 showing joint 110, a portion of handle 108, and a portion of leg 102, with handle 108 in the extended configuration.

Trough 128 may be configured to wrap around a first side 150 of first leg 102 when handle 108 is in the extended configuration.

As shown in FIGS. 7, 8 and 9, trough 128 may include a central portion 152 disposed between a first end portion 154 and a second end portion 156.

As shown in FIGS. 7 trough 128 may include a dome-shaped structure to help in moving the lock plug 126 in and out of pivoting position in order to help in extension and collapse of the handle 108. In other embodiments, central portion 152 of trough 128 may of any suitable shaped structure or recess to provide greater depth.

Lock plug 126 of joint 110 may be operable between an IN state (or IN position) and the OUT state (or OUT position). In FIG. 7, lock plug 126 is shown in the OUT state. As shown, the OUT state may correspond to distal end 126*a* of lock plug 126 positioned at proximal first end portion 154 of trough 128 when handle 108 is in the extended configuration such that lock plug 126 may extend into and frictionally engage first end portion 154 of trough 128 to prevent handle 108 from moving to the collapsed configuration. For example, lock plug 126 may contact (or press against) first end portion 154 of trough 128 when lock plug 126 is in the IN position, and thereby may block the movement of handle 108 about axis A1 from the extended configuration to the collapsed configuration.

As shown in FIG. 8, in the OUT position of plug 126, pin 132 may be positioned proximal (or may contact) first end 127*a* of slot 127, and spring 130 may extend (and be retained) between pin 132 and distal end (or cap) portion 126*a* of plug 126. Spring 130 may bias plug 126 to the OUT position by pressing against pin 132, and pin 132 may retain a proximal (or rear) portion of plug 126 in bore 142. Spring 130 may extend in the recess of lock plug 126. Lock plug 126 enclosing spring 130 may be disposed in bore 142.

Handle 108 may be moved between the extended configuration (see FIG. 1 and FIG. 6) and the collapsed configuration (see FIG. 6) by depressing lock plug 126 and flipping trough 128 to be in a configuration perpendicular to the lock plug 126. For example, FIG. 7 shows trough 128 disposed around a first side 126*b* of lock plug 126, FIGS. 8-9 show lock plug 126 released to the OUT state and trough 128 pivoting about axis A1.

The IN position of lock plug 126 may correspond to distal end 126*a* of lock plug 126 depressed to first end portion trough 128 to allow handle 108 to pivot about handle pivot axis A1 between the extended and collapsed configurations. In this IN position (see FIGS. 8-9), lock plug 126 may extend further into bore 142 of leg 102 than when lock plug 126 is in the OUT position (see FIGS. 7 and 8).

In some embodiments, central portion may frictionally engage depressed lock plug 126 and may apply appropriate pressure against a biasing force provided by spring 130 so that lock plug 126 may remain in the depressed position (i.e., the IN position) when handle 108 is moved between the extended configuration and the collapsed configuration (see FIGS. 7-10).

As previously described, lock plug 126 may be biased to the OUT state, for example, by spring 130. For example, spring 130 may apply a force on lock plug 126 in a direction from the IN state toward the OUT state. For example, as shown in FIGS. 8 and 9, the OUT state of lock plug 126 may correspond a less compressed state of spring 130, and as shown in FIG. 7, the IN state of lock plug 126 may correspond to a more compressed state of spring 130.

In the IN position of lock plug 126 shown in FIG. 7, handle 108 may pivot about handle pivot axis A1. As handle 108 pivots about handle pivot axis A1 to the collapsed configuration (as in FIG. 9), trough 128 may wrap around a pocket section (not shown in the figure) on under side of the seat 107.

Figure 10:
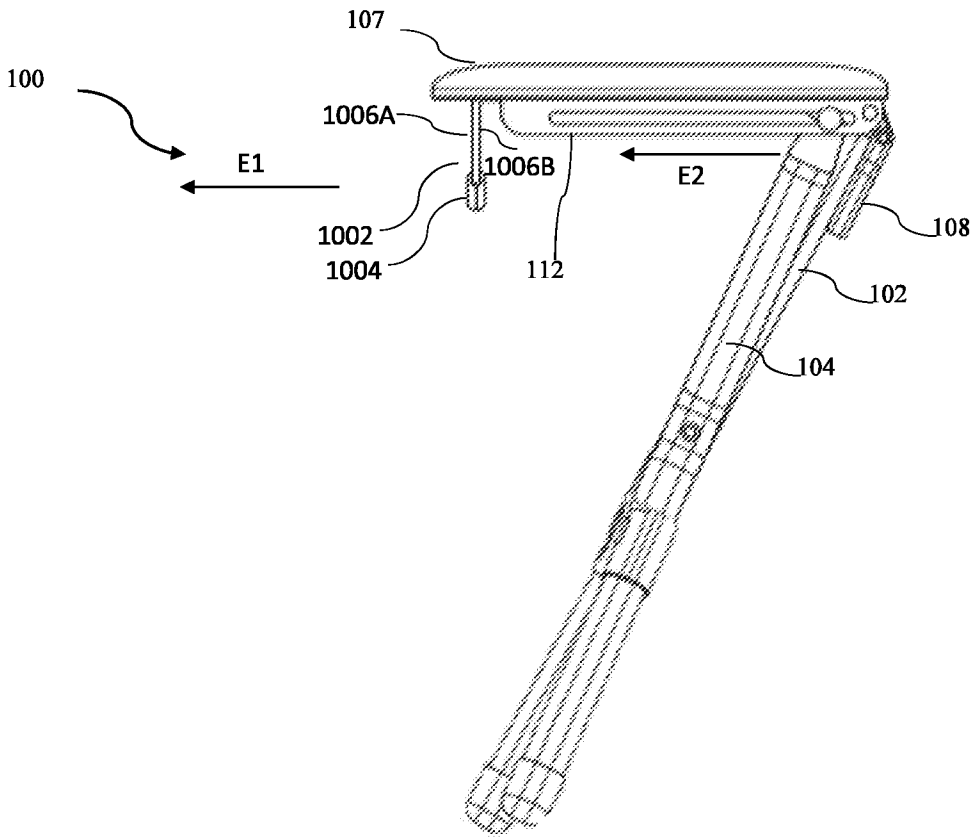
FIG. 10 is a side view of the chair in a collapsed configuration and displaying the pull cord mechanism in accordance with an embodiment of the invention.

FIG. 10 shows a side view of a chair 100, according to the present disclosure. As shown, chair 100 may include one or more legs, such as a first leg 102, a second leg 104, and a third leg 106, a seat 107, a handle 108 and a pull cord mechanism 1002. The pull cord mechanism may include a pull handle 1004 attached to at least a couple of cords 106A and 106B both of which are attached to the 104, and 106 at the other side.

Figure 11:
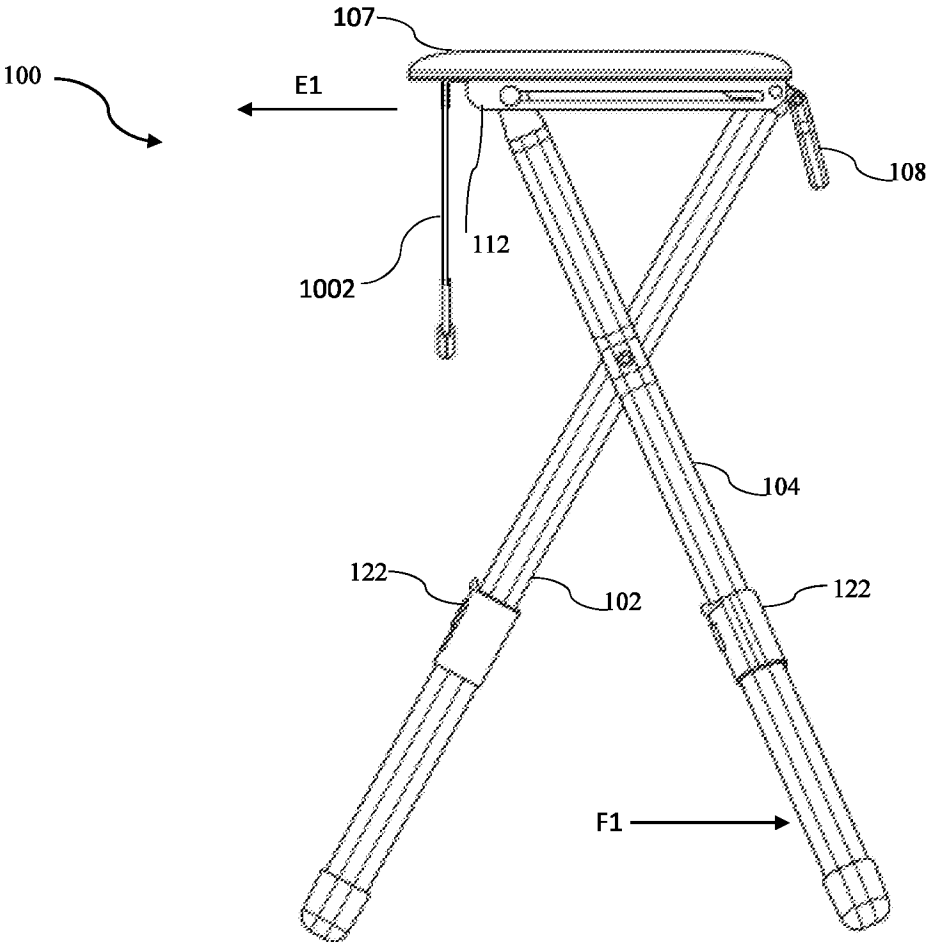
FIG. 11 is a side view of the chair in an extended configuration and displaying the pull cord mechanism in accordance with an embodiment of the invention.

As depicted, when the pull handle 1004 is pulled outward in the direction E1, the cords 106A and 1066 drag with them the legs 104 and 106 to direction E2 on the slots 112 and 114 thereby pulling the chair to an extended configuration as also depicted in FIG. 11. Further, to move the chair 100 from the extended configuration to the collapsed configuration, the legs 104 and 106 may be pushed inwards to a direction F1 as shown in the FIG. 11. This further, pulls the pull cord mechanism to its starting position moving opposite to the direction E1. It is to be noted that the first leg 102 is pivoted and does not move in any lateral direction.

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the inventions includes all novel and nonobvious combinations and subcombinations of the various elements, features, functions, and/or properties disclosed herein. The following claims particularly point out certain combinations and subcombinations regarded as novel and nonobvious. Inventions embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the inventions of the present disclosure.

What is claimed:

1. A chair operable between an extended configuration and a collapsed configuration, the chair comprising:

one or more legs supporting a seat;

a handle pivotally attached to a bottom portion of the seat;

a joint pivotally connecting the handle to at least one of the legs about a handle pivot axis;

an external pull cord mechanism, wherein the pull cord mechanism includes at least two cords attached to a pull handle on one end and to the one or more legs on the other end, wherein the pull cord mechanism is configured to switch the chair from the collapsed configuration to the extended configuration;

wherein the one or more legs includes a first leg, a second leg, and a third leg, each of the legs including a central portion connecting a lower portion to an upper portion, the central portion of the first leg being pivotally connected to the central portions of the second and third legs about a leg pivot axis;

wherein operating the chair from the collapsed configuration to the extended configuration involves pulling the pull handle of the pull cord mechanism in outward direction;

wherein the seat includes a front portion, a rear portion, and a pair of slots extending from the rear portion toward the front portion, the front portion of the seat being pivotally connected to the upper portion of the first leg about a seat pivot axis, the upper portions of the second and third legs including respective pins that are slidingly engaged in the slots, and operating the chair from collapsed configuration to the extended configuration involves the pins sliding toward the front portion of the seat, and the seat pivoting toward the leg pivot axis to position the upper portions of the first, second, and third legs between the seat and the handle; and wherein the pins define a sliding axis that is offset from the seat pivot axis in the collapsed configuration.

* * * * *